US006907219B2

(12) United States Patent
Kim et al.

(10) Patent No.: US 6,907,219 B2
(45) Date of Patent: Jun. 14, 2005

(54) FUSING EQUIPMENT OF IMAGE FORMING APPARATUS

(75) Inventors: Yong-geun Kim, Suwon (KR); Cheol-young Han, Yongin (KR)

(73) Assignee: Samsung Electronics Co., LTD, Suwon-si (KR)

( * ) Notice: Subject to any disclaimer, the term of this patent is extended or adjusted under 35 U.S.C. 154(b) by 0 days.

(21) Appl. No.: 10/420,870

(22) Filed: Apr. 23, 2003

(65) Prior Publication Data

US 2004/0001731 A1 Jan. 1, 2004

(30) Foreign Application Priority Data

Jun. 29, 2002 (KR) ..... 2002-37459

(51) Int. Cl.[7] ..... G03G 15/20

(52) U.S. Cl. ..... 399/328; 399/333; 219/216; 432/60

(58) Field of Search ..... 219/216; 432/60; 399/328–334

(56) References Cited

U.S. PATENT DOCUMENTS 5,915,147 A * 6/1999 Kouno et al. ..... 399/333
6,289,198 B1 * 9/2001 Kawamura et al. ..... 399/333

FOREIGN PATENT DOCUMENTS

| | | | | |
|---|---|---|---|---|
| JP | 06-011997 | | 1/1994 | |
| JP | 06301308 | A * | 10/1994 | ..... G03G/15/20 |
| JP | 07140825 | A * | 6/1995 | ..... G03G/15/20 |
| JP | 11-024474 | | 1/1999 | |
| JP | 2000-055605 | | 2/2000 | |
| JP | 2000-056607 | | 2/2000 | |
| JP | 2003098882 | A * | 4/2003 | ..... G03G/15/20 |
| KR | 1020010085213 | | 9/2001 | |
| KR | 20/0256087 | | 11/2001 | |

* cited by examiner

*Primary Examiner*—Arthur T. Grimley
*Assistant Examiner*—Ryan Gleitz
(74) *Attorney, Agent, or Firm*—Staas & Halsey LLP

(57) ABSTRACT

Fusing equipment of an image forming apparatus, includes: a fusing roller fixing a toner image on a printer paper and comprising a supporting layer formed at an inner portion of the fusing roller, a separating layer formed at an outermost portion of the fusing roller, an a heating layer formed between the supporting layer and the separating layer to supply heat; a thermistor detecting a temperature of the fusing roller to control the heating layer; and a pressing roller pressing the printing paper against an end of the fusing roller during a rotational movement of the fusing roller while being in contact with the fusing roller.

14 Claims, 3 Drawing Sheets

FUSING EQUIPMENT OF IMAGE FORMING APPARATUS

CROSS-REFERENCE TO RELATED APPLICATIONS

This application claims the benefit of Korean Patent Application No. 2002-37459, filed Jun. 29, 2002, in the Korean Intellectual Property Office, the disclosure of which is incorporated herein by reference.

BACKGROUND OF THE INVENTION

1. Field of the Invention

The present invention generally relates to an image forming apparatus, and more particularly, to fusing equipment of an electro-photographic image forming apparatus for fixing an image transferred thereto onto a paper.

2. Description of the Related Art

Generally, an electro-photographic image forming apparatus has a photosensitive drum that receives digital image signals from a laser scanning unit (LSU) and forms an electrostatic latent image accordingly, a developing unit that develops the electrostatic latent image of the photosensitive drum with a developing agent (hereinafter called 'toner'), and a transfer unit that transfers the developed image formed on the photosensitive drum onto a recording paper.

The transfer unit includes fusing equipment. The fusing equipment fixes the toner onto a printing medium with heat and pressure.

FIG. 1 shows conventional fusing equipment for use in an image forming apparatus. As shown in FIG. 1, the conventional fusing equipment includes a fusing roller 80 formed on an upper portion of the fusing equipment, a pressing roller 96 formed on a lower portion of the fusing equipment, and a thermistor 82 that detects a surface temperature of the fusing roller 80.

The fusing roller 80 includes a heating lamp 86 formed in a center portion of the fusing roller 80, an air layer 88 surrounding the heating lamp 86, a supporting layer 90 supporting the fusing roller 80, a resilient layer 92 formed of resilient material and surrounding the supporting layer 90, and a separating layer 94 surrounding the resilient layer 92. A halogen lamp is usually used as the heating lamp 86.

The pressing roller 96 rotates while being in contact with the separating layer 94 with an intervention of printing paper 99 therebetween. The pressing roller 96 is forced upward against the fusing roller 80 by a compression spring 98.

The thermistor 82 is in contact with the surface of the fusing roller 80, and detects the temperature of the rotating fusing roller 80. The fusing roller 80 fixes toner 95 on the printing paper 99 when the printing paper passes between the fusing roller 80 and the pressing roller 96.

In the conventional fusing equipment, radiation heat generated from the heating lamp 86 is transmitted to the supporting layer 90 via the air layer 88 and then transmitted through the resilient layer 92 to the separating layer 94, thereby transmitting the radiation heat to the printing paper 99.

At room temperature, a sufficient amount of heat is not quickly transmitted to the surface of the fusing roller 80 to melt the toner 95. Although there are differences in a melting point (temperature) of respective toner types of the toner 95 and a structure of the fusing equipment, it generally takes a longer period of time to warm up the fusing roller 80. When power is just turned on or when the printer is in a sleep state, it takes from about 30 seconds to about 1 minute for a mono laser beam printer (LBP), or from about 3 minutes to about 5 minutes for a color laser beam printer (CLBP) to be in a standby state, i.e., to be warmed-up for printing.

The printer enters into the sleep state to save energy consumption when there is no printing command for a long time. In the sleep state, the power to a heat source of the fusing roller 80 is cut off, thereby maintaining a fusing roller temperature at the room temperature. Then the printer enters into a standby state to be supplied with the printing paper. In the standby state, the fusing roller temperature is maintained at a lowest level that can be increased to a printing temperature allowing the printing at a maximum speed.

As mentioned above, it takes a lengthy time for the conventional fusing equipment to be warmed-up because it usually employs the halogen lamp as the heat source and is constructed in such a manner that the heating lamp 86 is heated inside of the supporting layer 90 of the fusing roller 80 to heat up the fusing roller 80 through the air layer 88.

Further, even though the supporting layer 90 is heated by the heat source, it takes a considerable time that the heat reaches the separating layer 94 disposed at the outer most side of the fusing roller 80 because the resilient layer 92, which surrounds the supporting layer 90, is made of materials of a low heat conductivity, such as a rubber.

Meanwhile, because the thermistor 82 is formed on an outside of the fusing roller 82 and is in contact with the surface of the separating layer 94, the thermistor 82 can be attached with foreign substances, such as dirt and dust. As a result, especially when it is used for a long time, the thermistor 82 would detect the surface temperature of the fusing roller inaccurately.

SUMMARY OF THE INVENTION

Accordingly, it is an aspect of the present invention to provide fusing equipment of an image forming apparatus which is warmed up within a short period of time as a fusing roller of the fusing equipment is heated directly by a heat source.

Another aspect of the present invention is to provide a fusing roller of an image forming apparatus, capable of supplying sufficient heat to a surface of the fusing roller even in a printing operation at high speed.

Yet another aspect of the present invention is to provide a fusing roller of an image forming apparatus which has an improved heating efficiency.

Additional aspects and advantages of the invention will be set forth in part in the description which follows and, in part, will be obvious from the description, or may be learned by practice of the invention.

The above and/or other aspects of the presenting invention are accomplished by providing fusing equipment of an image forming apparatus including a fusing roller and a pressing unit. The fusing roller comprises a supporting layer formed in an inner portion of the fusing roller, a separating layer formed on an outermost portion of the fusing roller, and a heating layer formed between the supporting layer and the separating layer to supply heat. The fusing equipment comprises a thermistor detecting a temperature of the fusing roller. The pressing unit presses a printing paper toward a lower end of the fusing roller during a rotational movement of the fusing roller while being in contact with the fusing roller.

The pressing unit can have the same construction as the fusing roller, whereby a pressing roller can serve a function of heating as well as pressing the printing paper.

The thermistor can be mounted in an inside of the fusing roller.

The supporting layer may be formed of a pipe which is made of a metallic material, such as aluminum or iron.

The heating layer includes a hot wire wound around an outer circumference of the supporting layer, an insulating member formed between the supporting layer and the hot wire, and an insulation resilient layer filled (disposed) in a first gap between windings of the hot wire created after the winding of the hot wire, and also filled (disposed) in a second gap between the hot wire and the separating layer. The insulation resilient layer has resiliency and insularity.

The hot wire is made of a material with a predetermined electric resistance, such as a tungsten or nichrom wire, and the insulation resilient layer is made of a material having a property of a silicone or a rubber that has an electric insularity, heat resistance and resiliency. Further, the insulation resilient layer can be formed of a material with high heat resistance, such as ceramics or mica.

The separating layer is coated with a material with a non-sticky property, such as polytetrafluoroethylene (TEFLON®, DUPONT), or is enclosed by a polytetrafluoroethylene (TEFLON®, DUPONT) tube.

According to another aspect of the present invention, fusing equipment of an image forming apparatus includes a fusing roller that has a supporting layer formed at an inner portion, a heating layer formed at an inside of the supporting layer to supply heat, a separating layer formed at an outermost portion, and a resilient layer formed between the supporting layer and the separating layer; a thermistor detecting a temperature of the fusing roller; and a pressing unit pressing a printing paper against a lower end of the fusing roller during a rotational movement of the fusing roller while being in contact with the fusing roller.

The heating layer includes a hot wire winding around an inner circumferential surface of the supporting layer and an insulating member having a heat resistance and charged (disposed) between windings of the hot wire and between the hot wire and the supporting layer.

The supporting layer may comprise a pipe made of a metallic material, such as aluminum or iron, and the hot wire is made of a material with a predetermined electric resistance, such as a tungsten wire or a nichrom wire.

The resilient layer is made of a material having a property of either a silicone or a rubber, and the separating layer is coated with a material of a non-sticky property, such as polytetrafluoroethylene (TEFLON®, DUPONT), or is enclosed by a polytetrafluoroethylene (TEFLON®, DUPONT) tube.

According to another aspect of the present invention, instead of a conventional indirect heating method by which a heating source, such as a halogen lamp, radiates heat through the air, a direct heating method is used. Accordingly, the supporting layer and the separating layer both disposed in an inside of the fusing roller can be intervened by the heating layer, or the heating layer can be formed to be in direct contact with an inner surface of the supporting layer to directly heat a surface of the fusing roller. As the image forming apparatus can reach a print fusing temperature within a short period of time, a warm-up time is shortened, and a given image is printed out rapidly. Further, a sufficient amount of heat can be supplied to the fusing roller even in a printing operation at high speed, and a heating efficiency of the fusing roller is improved.

Further, by forming the thermistor in the inside of the fusing roller, the thermistor can be kept free from foreign substances, such as dust, and as a result, inaccurate temperature detection of the thermistor can be prevented.

BRIEF DESCRIPTION OF THE DRAWINGS

These and other aspects and advantages of the invention will become apparent and more readily appreciated from the following description of the preferred embodiments, taken in conjunction with the accompanying drawings of which.

DESCRIPTION OF THE PREFERRED EMBODIMENTS

Figure 1:
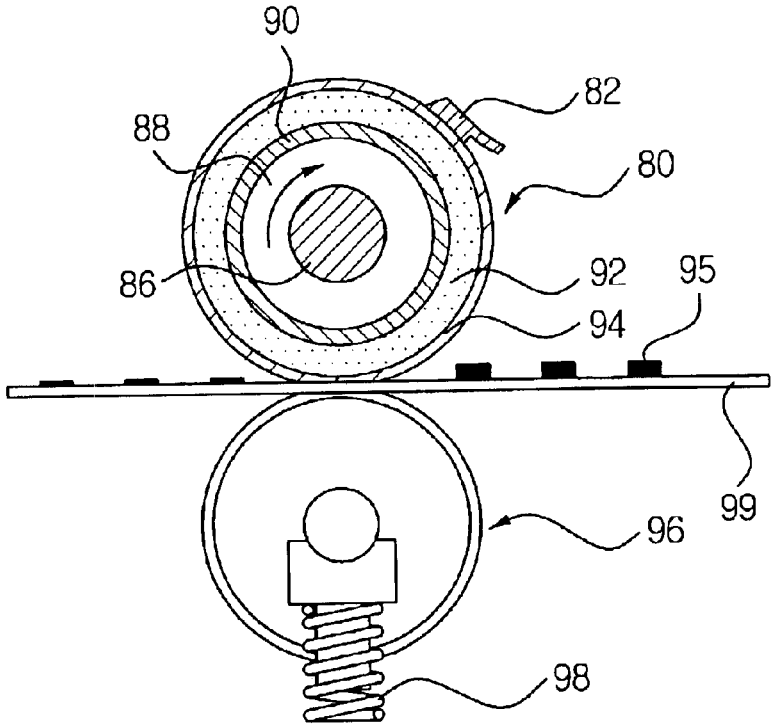
FIG. 1 (PRIOR ART)
FIG. 1 is a cross-sectional view showing conventional fusing equipment of an image forming apparatus.

Reference will now be made in detail to the present preferred embodiments of the present invention, examples of which are illustrated in the accompanying drawings, wherein like reference numerals refer to the like elements throughout. The embodiments are described in order to explain the present invention by referring to the figures.

Hereinafter, the embodiments of the present invention will be described in greater detail with reference to the accompanying drawings.

Figure 2:
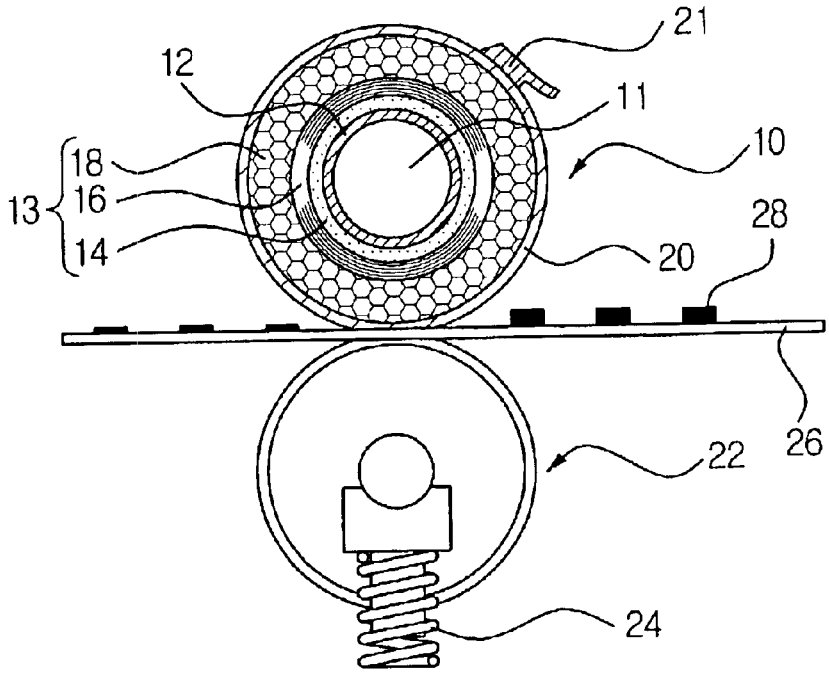
FIG. 2 is a cross-sectional view showing a direct heating type of fusing equipment in an image forming apparatus according to an embodiment of the present invention.
Figure 3:
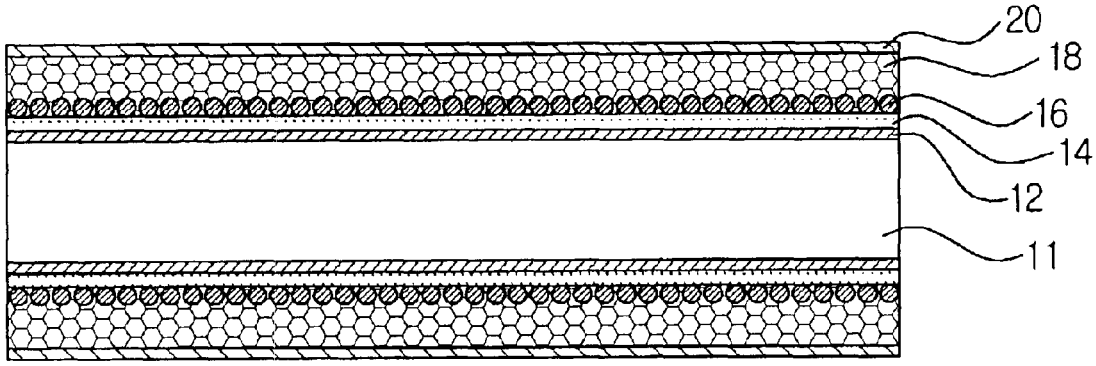
FIG. 3 is a longitudinal cross-sectional view showing an internal structure of the fusing equipment of FIG. 2.

FIGS. 2 and 3 are cross-sectional views showing fusing equipment according to an embodiment of the present invention. As shown in FIGS. 2 and 3, the fusing equipment includes a fusing roller 10 formed at an upper portion of the fusing equipment, a pressing roller 22 formed at a lower portion of the fusing equipment, and a thermistor 21 that defects a surface temperature of the fusing roller 10. The pressing roller 22 is urged upward against the fusing roller 10 by a compression spring 24. The fusing roller 10 fixes toner 28 on printing paper 26 when the printing paper passes between the fusing roller 10 and the pressing roller 22.

The fusing roller 10 has a center portion 11, a supporting layer 12 surrounding the center portion 11, a separating layer 20 defining an outer-most surface of the fusing roller 10, and a heating layer 13 formed between the supporting layer 12 and the separating layer 20. The supporting layer 12 supports the fusing roller 10.

The heating layer 13 includes a hot wire 16 wound around an outer circumference of the supporting layer 12, an insulating material 14 formed between the supporting layer 12 and the hot wire 16, and an insulating resilient layer 18 disposed in a first gap between windings of the hot wire created after the winding of the hot wire, and also disposed in a second gap between the hot wire 16 and the separating layer 20. The first gap and the second gap are filled with the insulating resilient layer 18.

Taking a heat efficiency and a lifespan of the hot wire 16 into account, the hot wire 16 is formed of materials with a predetermined electric resistance, i.e., a tungsten wire, a nichrom wire, etc. For a better resiliency of the fusing roller 10, the insulating resilient layer 18 is made of silicone or materials having a rubber property with a high electric insulation, a heat resistance, and a resiliency. If there is no requirement for the resiliency, the insulating resilient layer 18 is made of materials with a high heat and electric insulation, such as ceramics, mica, etc.

The separating layer 20 is coated with polytetrafluoroethylene (TEFLON®, DUPONT) that has an excellent non-sticky property, or is enclosed by a polytetrafluoroethylene (TEFLON®, DUPONT) tube. The supporting layer 12 comprises a pipe of a metallic material, such as aluminum (Al) or iron (Fe), to provide a mechanical strength to the supporting layer 12. The supporting layer 12 stores the heat generated from the heating layer 13 therein and transmits the stored heat to the separating layer 20 together with the heat from the heating layer 13.

By forming the heating layer 13 between the supporting layer 12 and the separating layer 13, the heating layer 13 directly heats the outer-most layer of the fusing roller 10, i.e., the separating layer 20. As a result, a warm-up time of the image forming apparatus is shortened, and a sufficient amount of the heat is transmitted to the surface of the fusing roller 10, thereby increasing the heating efficiency of the fusing equipment.

Figure 4:
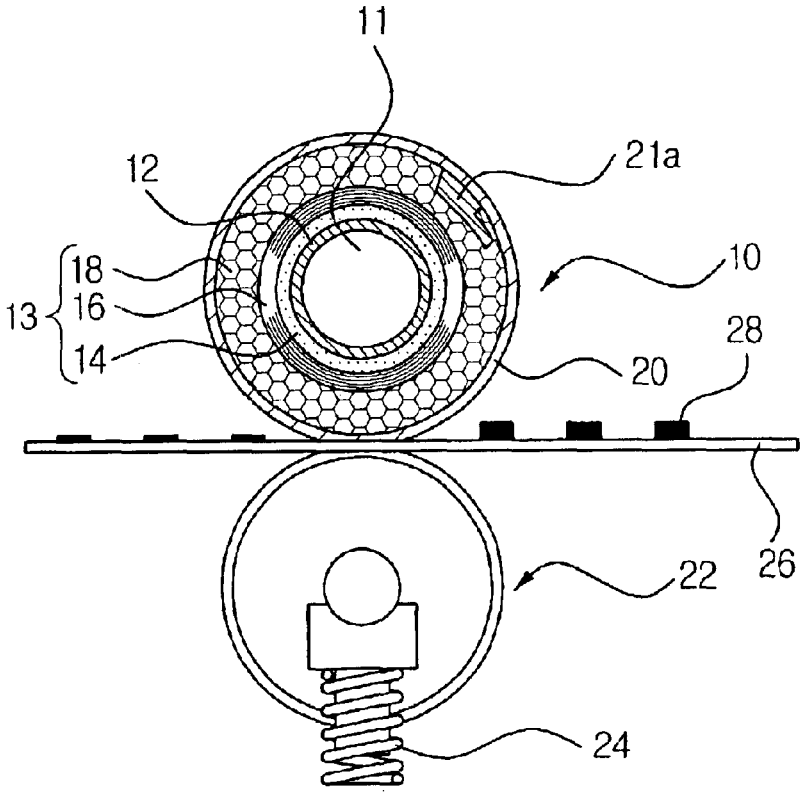
FIG. 4 is a cross-sectional view showing fusing equipment according to another embodiment of the present invention.

FIG. 4 is a cross-sectional view showing fusing equipment according to another embodiment of the present invention. As shown in FIG. 4, a basic structure of the fusing equipment is similar to that of the fusing equipment shown in FIGS. 2 and 3. Accordingly, the like elements will be given the same reference numerals throughout, and description thereof will be omitted. According to this embodiment of the present invention, the fusing equipment is provided with a thermistor 21*a* which is inserted in the heating layer 13 to detect the surface temperature of the fusing roller 10.

During rotating together with the fusing roller 10, the thermistor 21*a* is disposed in the insulation resilient layer 18 of the heating layer 13 and contacts with the separating layer 20 to thereby detect the surface temperature of the separating layer 20.

By constructing the fusing equipment as described above, the thermistor 21*a* can remain free from foreign substances, such as dust, for a long period of time.

Figure 5:
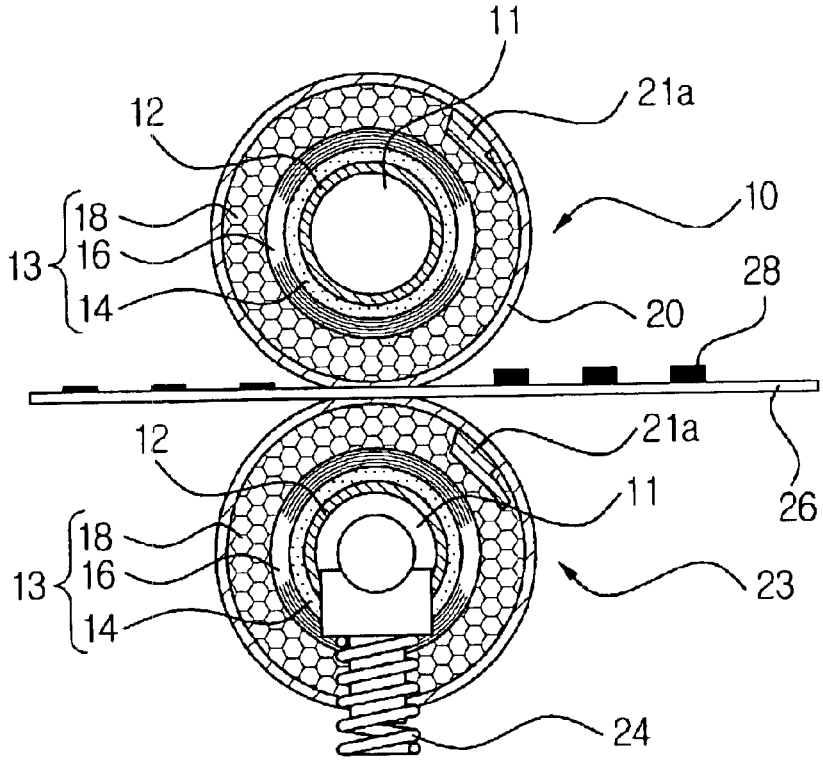
FIG. 5 is a cross-sectional view showing fusing equipment according to another embodiment of the present invention.

FIG. 5 is a cross-sectional view showing fusing equipment according to another embodiment of the present invention. As shown in FIG. 5, the fusing equipment is provided with the pressing roller 23 and the fusing roller 10, both of which are constructed in the same way. Further, the thermistor 21*a* is inserted in the heating layer 20. The other basic structures are the same as the fusing equipment shown in FIGS. 2 through 4.

By constructing the fusing roller 10 and the pressing roller 23 in the same structure, a heat transmission can be made through a direct pressure from upper and lower rollers, such as the fusing roller 10 and the pressing roller 23, to the printing paper. As shown in FIG. 5, the fusing equipment in a sleep state can reach the print fusing temperature within a shortest time and also supply a sufficient amount of heat even during a printing operation at a high speed.

Figure 6:
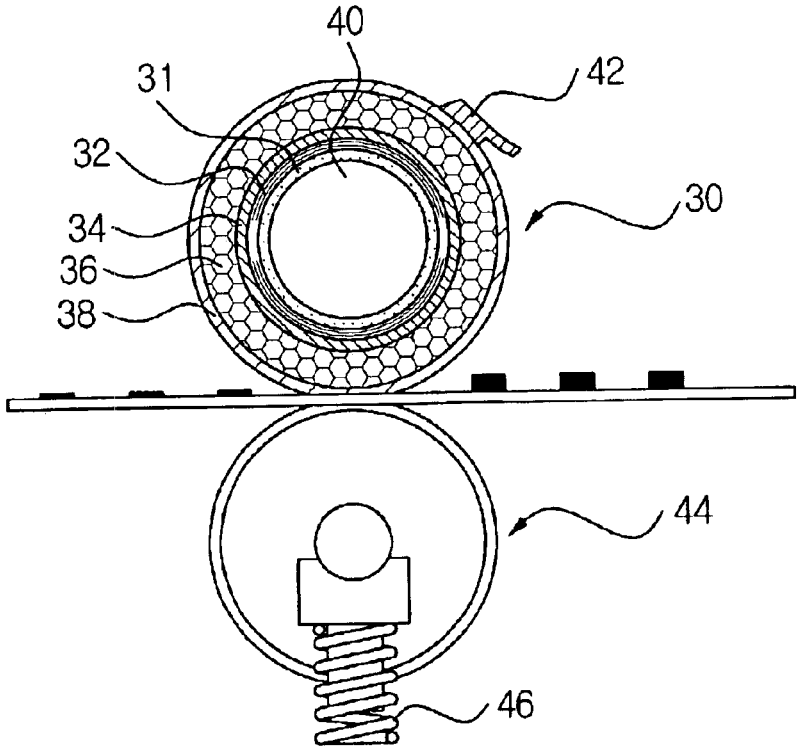
FIG. 6 is a cross-sectional view showing fusing equipment according to another embodiment of the present invention.

FIG. 6 is a cross-sectional view showing fusing equipment according to another embodiment of the present invention. The fusing equipment, like as in the first, second and third embodiments, includes a fusing roller 30 having a center portion 40, a thermistor 42 and a pressing roller 44.

As shown in FIG. 6, the fusing roller 30 includes a supporting layer 34, a hot wire 32 wound around an inner surface (circumference) of the supporting layer 34, an insulation material 31 disposed in a first gap formed between windings of the hot wire 32 created after the winding of the hot wire 32, and also disposed in a second gap formed between the hot wire 32 and the inner circumference of the supporting layer 34. Further, a resilient layer 36 is formed between the supporting layer 34 and the separating layer 38 to provide a resiliency to the fusing roller 30. The thermistor 42 is in contact with a surface of the separating layer 38 from an outside of the fusing roller 30. The pressing roller 44 is urged upward against the fusing roller 30 by a compression spring 46.

The supporting layer 34 comprises a pipe made of a metallic material, such as aluminum (Al) or iron (Fe). The hot wire 32 is formed of materials with a proper electric resistance, such as a tungsten or nichrom wire. The separating layer 38 is coated with polytetrafluoroethylene (TEFLON®, DUPONT) or is enclosed by a polytetrafluoroethylene (TEFLON®, DUPONT) tube.

Although the preferred embodiments of the present invention have been described, it will be understood by those skilled in the art that the present invention should not be limited to the described preferred embodiments, but various changes and modifications can be made within the spirit and scope of the present invention as defined by the appended claims and their equivalents.

What is claimed is:

1. Fusing equipment of an image forming apparatus, comprising:

a fusing roller fixing a toner image on a printing paper and comprising a supporting layer formed at an inner portion of the fusing roller, a separating layer formed at an outermost portion of the fusing roller, and a heating layer formed between the supporting layer and the separating layer to supply heat;

a thermistor detecting a temperature of the fusing roller to control the heating layer; and a pressing roller pressing the printing paper against an end of the fusing roller during a rotational movement of the fusing roller while being in contact with the fusing roller, wherein the heating layer includes a hot wire wound around an outer circumference of the supporting layer, and wherein the pressing roller includes:

a second supporting layer formed at an inner portion of the pressing roller;

a second separating layer formed at an outermost portion of the pressing roller; and a second heating layer formed between the supporting layer and the separating layer to supply heat.

2. The fusing equipment of claim 1, wherein the supporting layer comprises:

a pipe made of a metallic material containing either aluminum or iron.

3. The fusing equipment of claim 1, wherein the thermistor is formed on an inside of the fusing roller.

4. The fusing equipment of claim 1, wherein the hot wire includes a material having electric resistance as a tungsten or nichrom wire.

5. Fusing equipment of an image forming apparatus, comprising:

a fusing roller fixing a toner image on a printing paper and comprising a supporting layer formed at an inner portion of the fusing roller, a separating layer formed at an outermost portion of the fusing roller, and a heating layer formed between the supporting layer and the separating layer to supply heat;

a thermistor detecting a temperature of the fusing roller to control the heating layer; and a pressing roller pressing the printing paper against an end of the fusing roller during a rotational movement of the fusing roller while being in contact with the fusing roller, wherein the heating layer includes:

a hot wire wound around an outer circumference of the supporting layer, an insulating member formed between the supporting layer and the hot wire; and an insulation resilient layer disposed in a first gap formed between windings of the hot wire created after the winding of the hot wire, and also disposed in a second gap formed between the hot wire and the separating layer, the insulation resilient layer having a resiliency and an insularity.

6. The fusing equipment of claim 5, wherein the insulation resilient layer comprises:

a material having a property of a silicone or a rubber.

7. The fusing equipment of claim 5, wherein the separating layer comprises:

a material coated on the separating layer and having the same non-sticky property as polytetrafluoroethylene, and a polytetrafluoroethylene tube enclosing the separating layer.

8. The fusing equipment of claim 5, wherein the supporting layer comprises:

a pipe which is made of a metallic material containing either aluminum or iron.

9. The fusing equipment of claim 8, wherein the separating layer comprises:

one of a material coated on the separating layer and the same non-sticky property as polytetrafluoroethylene, and a polytetrafluoroethylene tube enclosing the separator layer.

10. Fusing equipment of an image forming apparatus, comprising:

a fusing roller fixing a toner image on a printing paper and, comprising a supporting layer formed at an inner portion of the fusing roller, a heating layer formed at an inside surface of the supporting layer to supply heat to an outermost portion of the fusing roller through the supporting layer, a separating layer formed at the outermost portion of the fusing roller, and a resilient layer formed between an outside surface of the supporting layer and the separating layer;

a thermistor detecting a temperature of the fusing roller to control the heating layer; and a pressing roller pressing the printing paper against an end of the fusing roller during a rotational movement of the fusing roller while being in contact with the fusing roller, wherein the heating layer includes a hot wire wound around an inner circumference of the supporting layer.

11. The fusing equipment of claim 10, wherein the heating layer includes an insulating member having a heat resistance, disposed in a first gap formed between windings of the hot wire created after the winding of the hot wire, and also disposed in a second gap formed between the hot wire and the supporting layer.

12. The fusing equipment of claim 10, wherein the supporting layer comprises:

a pipe made of a metallic material containing either aluminum or iron.

13. The fusing equipment of claim 10, wherein the hot wire includes a material having an electric resistance of a tungsten wire or a nichrom wire.

14. The fusing equipment of claim 10, wherein the resilient layer comprises:

a material having a property of either a silicone or a rubber.

* * * * *